United States Patent [19]

Rusteberg et al.

[11] 4,007,367

[45] Feb. 8, 1977

[54] SEMEN THAW SYSTEM

[76] Inventors: Robert K. Rusteberg, R.R. 2, P.O. Box 153 Algonquin Road, Barrington Hills, Ill. 60010; Robert J. Froehlich, 210 S. Louis, Mount Prospect, Ill. 60056

[22] Filed: Feb. 2, 1976

[21] Appl. No.: 654,539

[52] U.S. Cl. ..... 219/385; 128/1 R; 128/214 A; 195/1.8; 219/437; 219/441; 219/521

[51] Int. Cl.[2] ..... F27D 11/00

[58] Field of Search ..... 219/385, 386, 387, 437, 219/438, 439, 441, 521, 525; 128/1 R, 214 A; 62/158; 195/1.7, 1.8, 127

[56] References Cited

UNITED STATES PATENTS

| | | | |
|---|---|---|---|
| 2,572,155 | 10/1951 | Hoyt | 128/234 |
| 3,712,268 | 1/1973 | Reed | 219/385 X |
| 3,764,780 | 10/1973 | Ellis | 219/441 X |
| 3,801,278 | 4/1974 | Wagner et al. | 219/521 X |

OTHER PUBLICATIONS

"Resume of Investigations Concerning the Preservation of Semens by Freezing," Sept. 8, 1953, 9 pages.

*Primary Examiner*—Yolodymyr Y. Mayewsky
*Attorney, Agent, or Firm*—Robert E. Wagner; Leo J. Aubel

[57] ABSTRACT

This invention relates to an apparatus for thawing frozen semen for use in artificial insemination of animals. More particularly, the system relates to an apparatus for thawing semen while retaining maximum cell yield by minimizing loss of semen activity.

3 Claims, 6 Drawing Figures

100°F
80°F
60°F
40°F
20°F
0°F
0
10 MIN
20 MIN
30 MIN
30°F

100°F
0°F
-100°F
0S
5S
10S
15S
20S
25S
85S
90S
R
C

BUZZER
LED
TIMER
THERMISTOR CONTROL
HEATER
HEATER
THERMISTOR CONTROL

TIMING
POWER
READY

SEMEN THAW SYSTEM

BACKGROUND OF THE INVENTION

A number of improvements in the technique of artificial insemination of animals have been made in recent years to improve the effectiveness and efficiency of results. An initial problem was the fact that semen could not be efficiently stored for any appreciable length of time. This hurdle was overcome by utilizing a process of freezing the semen at liquid nitrogen temperatures for storage. However, the activity of the semen decreases considerably upon thawing; this decrease in activity is generally attributed to damage occurring to the semen cells during the thawing process. More specifically, a critical period appears to occur during the physical stage when the semen is in a semi-crystalline state, at the transition temperature range from a frozen storage state to a liquid operational state. It has been found that an increase in the rapidity with which the semen is passed through this critical semicrystalline state, results in a corresponding reduction in damage to the cells, and the resulting activity of the semen and success of the insemination is much greater than formerly observed.

In an effort to increase the activity of the thawed semen prior to injection, various expedients are disclosed in the prior art. For example, the semen is inserted into an elongated plastic tube or straw and the straw itself has been decreased in size and mass and designed to expose more surface area of the semen to the heating medium. Ice baths, as well as baths slightly higher in temperature than the ice baths, have been employed in an effort to increase the heat gain of the straw. However, these efforts have generally failed to produce an acceptable level of activity upon thawing of the frozen semen. In general, these prior art efforts allow the semen to remain in the critical temperature range of partially crystalline semen for an unacceptable length of time; and, as mentioned above, an undesirable amount of damage to the semen cells occurs.

SUMMARY OF THE INVENTION

The present invention provides a system for thawing frozen semen wherein the semen passes quickly through a critical temperature range; that is, the semi-crystalline semen remains within a critical temperature range a minimum period of time. In the apparatus of the present invention, the straw or vial containing the semen is placed in a thawing chamber including a water bath heated to a controlled constant temperature of 140° Fahrenheit. The length of time that the temperature of the semen straw remains in the critical temperature range previously discussed, is decreased to approximately two seconds. Once the semen in the straw is thawed, the straw is removed from the thawing chamber and inserted into a second or holding chamber where the straw is kept at a rather constant temperature of 95° F. ready for use.

The thawing chamber is electronically timed and temperature controlled. When the semen straw is inserted into the thawing chamber for thawing, a timing switch is depressed, setting in operation the timer mechanism. At the end of the thaw cycle, as set by the timer, aural and visual indicators provide a signal. The operator then removes the straw either for injection purposes or for placing into the holding chamber where the straws are maintained at a constant temperature for subsequent injection. The holding chamber is readily portable and enables the user to carry an injector or sheath as well as a supply of semen straws to permit the animals to be injected at the selected temperature.

The inventive system quickly thaws semen straws thus providing greater convenience and efficiency in performing artificial insemination. The rapid, electronically controlled application of heat, accelerates the thaw cycle.

An important advantage of the inventive system is that it provides an increase in the cell yield over conventional methods.

A principal object of the subject invention is the provision of a system for thawing semen straws which minimize loss of semen activity.

A further object of the present invention is the provision of a thawing chamber and a holding chamber to enable an operator to prepare a series of semen straws in the thawing chamber which may then be placed in a holding chamber for subsequent use and conveniently carried to the area of use.

A further object of the present invention is an electronically controlled system which allows the thawing and storage of a semen straw with a minimum loss of activity of the semen contained therein.

The foregoing and other objects, features and advantages of the invention will be apparent from the following more particular description of preferred embodiments of the invention as illustrated in the accompanying drawings wherein:

DESCRIPTION OF THE INVENTION

Figures 1, 2, 3, 4, 5, 6:
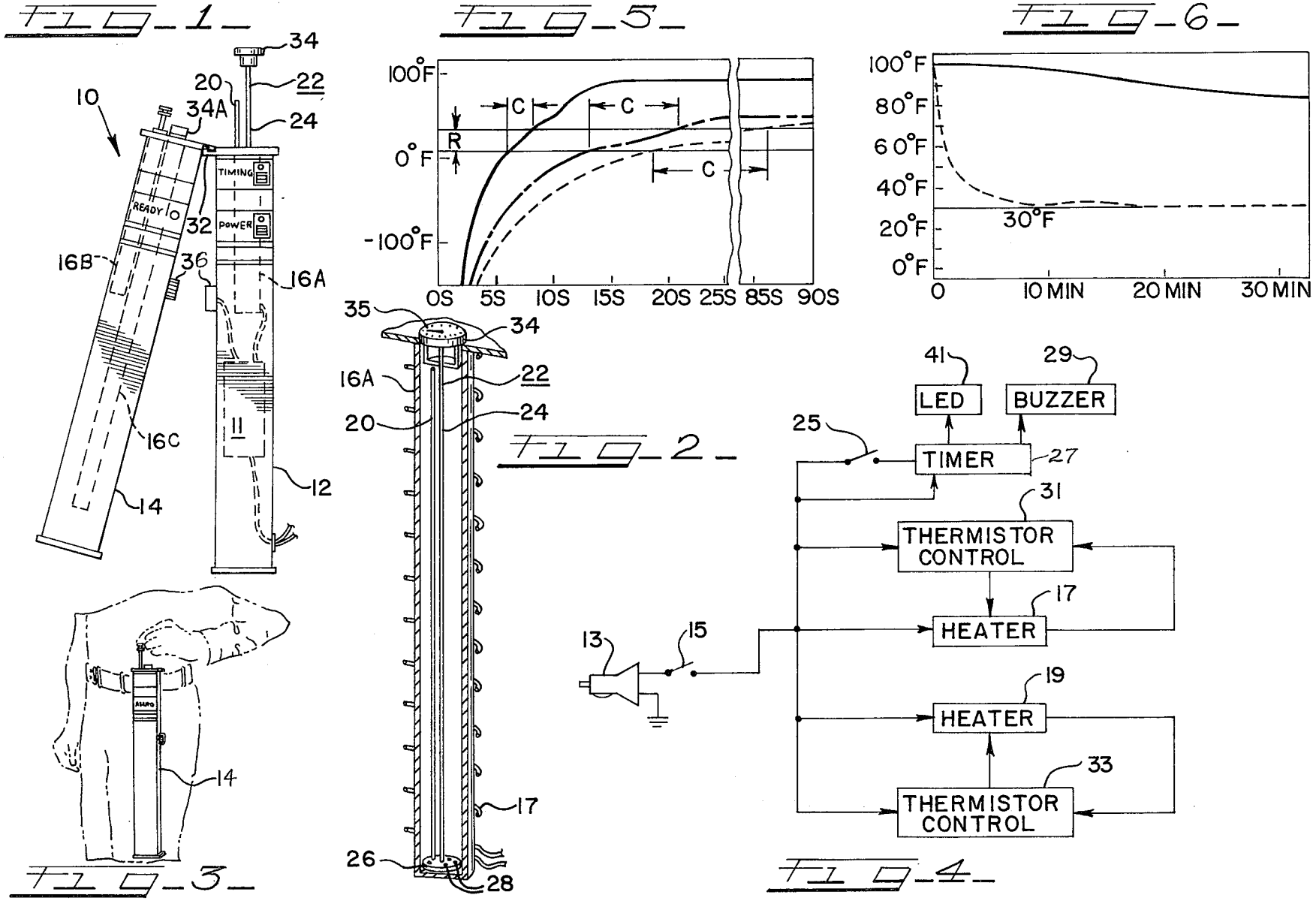
FIG. 1 is a front view showing a chamber for thawing the semen straws, and a chamber for holding and storing the semen straws after they have been thawed; and, the mechanical and electrical connection of the two chambers.
FIG. 2 is a relatively enlarged isometric cut away view of the heating tube or container which is mounted in the thawing chamber of FIG. 1.
FIG. 3 is an isometric view showing the holding chamber mounted on the belt of the user.
FIG. 4 is a block diagram of the electronic heating and control circuit of the invention.
FIG. 5 is a graph useful in explaining the inventive concept of the invention; and, FIG. 6 shows the temperature stability of the straw positioned in the holding chamber.

Referring first to FIG. 1, the inventive system 10 includes a pair of elongated rectangular chambers or casings 12 and 14. In one embodiment, the chambers are approximately 17 inches in length, 2 inches in width and 1 inch in depth. Each of the chambers 12 and 14 includes a respective sleeve container or elongated tubing 16A and 16B (see also FIG. 2), each container having an open top and a closed bottom end. Containers 16A and 16B receive the semen straws which are made out of a suitable plastic, as is known in the art. In addition, chamber 14 which is the semen straw holding or hold chamber, includes another sleeve container 16C which is of longer length than containers 16A and 16B and is used to hold the injectors or sheaths for the semen straws.

Chambers 12 and 14 may be mechanically engaged by any suitable tongue and groove arrangement indicated at 32 which, in conjunction with a suitable malefemale electrical socket connector 36 mounted on the sides of chambers 12 and 14, and maintains the chambers in relatively locked engagement.

The semen straws 20 are thawed, in container 16A of thawing chamber 12, then placed in the container 16B in chamber 14 and maintained within a selected temperature range. Suitable electrical connections are provided through the circuitry of FIG. 2 to provide the thawing and temperature or heat maintaining functions, as will be explained.

As mentioned, after thawing, the semen straws 20 are placed in the container 16B of chamber 14. Chamber 14 may be separated and electrically disconnected from chamber 12 as indicated in FIG. 1 to be carried such as on the belt of the user as indicated in FIG. 3. The hold chamber 14 maintains the semen straws 20 warm and ready for use until withdrawn as required for usage.

The chamber 12 further includes the electronic circuitry 11 shown in FIG. 4 which is utilized to precisely heat and thaw the frozen semen straws in a predetermined time period, as will be explained.

An insert rod 22 includes an elongated portion 24 with a circular bottom basket 26 and a top cap 34. Basket 26 includes recesses 28 formed adjacent its periphery to permit the water to drain or flow therethrough when the rod and basket are being inserted or withdrawn from container 16A. Top cap 34 closes and seals the container 16A and includes an integral thermometer 35 for indicating the temperature of the water in the container 16A.

In use, the rod 22 and basket 26 are partially inserted into container 16A and the ends of the semen straws 20 are next positioned in basket 26 around rod 22 and the rod, basket and straws are then completely inserted into container 16A. Cap 34 closes the open top of container 16A.

The graphs of FIG. 5 show a temperature vs. time comparison wherein the axis of ordinates is in degrees Fahrenheit and the axis of abscissas is time in seconds. FIG. 5 shows three curves indicating typical semen straw thawing cycles of different systems to enable comparison of the thawing cycle and operation of two prior art systems as against the inventive system.

A principal feature of the inventive concept concerns the operation of the inventive system as relates to the temperature range indicated as R between the two horizontal lines in FIG. 5. To explain, during the thawing cycle, it has been found that the semen which has been frozen, such as in liquid nitrogen, as it is heated goes through the temperature range R during which the frozen semen in the straws changes from a crystalline structure to a liquid. A rather critical period, indicated as C in each of the curves of FIG. 5, depicts the time required for the temperature of the semen to pass through range R. It has been found that the shorter the period of time C required for the semen to pass through the temperature range R, the less will be the loss in semen activity.

Certain prior art teaches the use of ice water to thaw the frozen semen. As can be seen from the dotted line in FIG. 5, when ice water thawing is employed, the semen remains within critical temperature range R for over 60 seconds. Further, as can be seen from the dotted line graph, the time required to thaw the semen and for the semen to reach a suitable temperature is relatively long. This will result in a relatively great loss in semen activity.

Certain other prior art systems thaw the semen at about a 34° temperature. The dot-dash line of FIG. 5 shows that the semen will be within critical temperature R range for about seven seconds, which is a significant improvement over the ice water thawing method.

The results of the thawing action when using the inventive system is shown by the heavy solid line in FIG. 5. Note that the semen is in the critical temperature range C for only approximately two seconds. Accordingly, the inventive system provides a means of thawing the semen while retaining a very high percentage of the semen activity; or, said in another way, it minimizes the loss of the semen activity caused by the thawing action. It has been found that by using the system and technique of the present invention, increases the live cell count to a higher percentage of the total volume as compared with the prior system and methods. Obviously, this significantly enhances the probability tht pregnancy in the animal will occur.

The effect of the semen storage or hold chamber 14 is shown in FIG. 6. Assuming a relatively low ambient temperature of 30° F., the semen hold chamber will retain the semen straws stored therein at a relatively constant temperature as indicated by the solid line curve as compared to the exposed semen straws as indicated by the dotted line curve. FIG. 3 depicts the convenient portability of the chamber 14.

Electronic Heater and Control Circuit

The electronic heater and control circuitry 11 of the invention is shown in the block diagram of FIG. 4. The electronic heater and control circuitry 11 is connectable to a source of power such as an electric cigarette lighter 13 of an automobile, indicated schematically in FIG. 4. Circuitry 11 may also be connected to any suitable 12 volts D.C. power supply package which can be connected to a regulated 115 A.C. outlet. An On-Off switch 15 switches the source of power to the circuitry 11. Suitable On-Off lights may be included as is well known, to indicate switch 15 is in an On position. The circuitry 11 includes well known resistive heater coils 17 and 19 (see also FIG. 2), which are energized by the power source and are electronically controlled by the remaining portion of the circuitry 11 to provide heat to the containers 16A and 16B in respective chambers 12 and 14. Thermistor control circuits 31 and 33 of any suitable known design, (in one embodiment, GA 51J1 Thermistors are used) control the power applied to the respective heaters 17 and 19.

A toggle type spring return switch 25 is provided, which switch is a single position, normally open switch and which may be manually actuated and held in a closed position to energize the timer 27. Timer 27 may be of any suitable known type and in one embodiment, commprises a ICl dual timer available from the RCA Company.

A suitable electrical buzzer 29 (which in one embodiment comprises a Tung-Sol 902 buzzer) provides an audible indication to indicate the timer 27 has timed a preset time period. In one embodiment, the timer is set to count to or time out 12 seconds, and at the end of the 12 seconds, the timer permits buzzer 29 to be activated. The twelve second timing period has been selected to provide a suitable heating cycle while also taking into consideration the operator's reaction time. Buzzer 29 buzzes to indicate to the operator the end of the preset time period, and at that point, switch 25 is opened.

A light emitting diode, LED 41, is also connected in parallel with buzzer 29 and is energized and lights during the timing period and thus visually indicates the timing period.

Utilization of the System

To operate the system, containers 16A and 16B of chambers 12 and 14 respectively are filled with water to a preset level. The power is next connected to the electronic circuitry 11 froma source 13 by closing the power switch 15. The semen straw 20 containing the frozen semen is placed in position on basket 26 and the basket is inserted into the container 16A of the thawing chamber 12, while pressing down or closing the timer switch 25.

The current is applied through respective heaters 17 and 19 to heat the containers 16A and 16B in chambers 12 and 14. The heater 17 supplies heat to container 16A during the thawing cycle to thaw the frozen semen straws 20. Thermistor controls 31 and 33 monitor and control the temperature applied by means of coils 17 and 19 to containers 16A and 16B respectively.

The frozen semen straws 20 will be thawed during the thawing cycle of 12 second duration. Note that the preset period of time or thawing cycle may vary or be varied dependent on factors such as the dimensions of the straw. The timer 27 is set to time out the aforesaid thawing cycle period and LED 41 is energized at the same time to light and visually indicate the timing cycle is in process. Upon counting or timing of the twelve second period, the timer 27 will actuate buzzer 29 to buzz and provide an indication that the heat cycle is complete.

The rapid thaw takes the frozen semen through the critical de-crystalline stage quickly to minimize cell damage. The semen straws 20 are then removed from the container 16A in thawing chamber 12 and placed in container 16B of the holding chamber 14.

The heater 19 heats its container 16B in chamber 14 to a level of approximately 95° F. As mentioned above, the thermistor control 33 monitors the heat developed by heater 19 to heat container 16B in preparation for receiving the thawed straws 20.

In one embodiment of the operation of the inventive system, the following tolerances have been found satisfactory. The temperature of the water in the thawing chamber 12 should be in the range of 140° ± 5° F.; the temperature of the water in the hold chamber 14 should be in the range of 95° F. ± 3° F., and the thawing cycle should be 12 seconds ± 2 seconds.

The cap 34A on container 16B is then sealed to prevent leakage. As indicated above, the holding chamber 14 may then be electrically and mechanically detached from the thawing chamber 12 and fastened on to the user's belt by a suitable clip and the system is ready for use. Obviously, several holding chambers may be used to further expand the flexibility of the system.

While the invention has been particularly shown and described with reference to preferred embodiments thereof, it will be understood by those skilled in the art that various changes in form and details may be made therein without departing from the spirit and scope of the invention.

We claim:

1. A system connectable to a source of electrical power for controllably thawing frozen semen contained in semen straws for use in artificial insemination of animals comprising, in combination, a first casing having a container for receiving the straws of frozen semen, electrical heating means for said container and connectable to said source for controllably heating the containers from a first temperature to an elevated temperature for causing the semen to pass from its crystalline to a liquid state in a preselected time of relatively few seconds, presettable electronic timer means for timing the heating period, electrical switch means having first and second operating positions, said switch means being operable to its first position to electrically connect the heating means to the source, said switch means in its first position concurrently causing the electronic timer means to be activated, indicating means operable in response to said electrical timer means for indicating the completion of the preset heating time period, and said switch means being selectively operable to its second position to electrically disconnect the heating means from the source, whereby the semen may be controllably heated through the critical transition stage from its crystalline to its liquid state within a preselected time to thereby retain maximum cell yield by minimizing loss of semen activity.

2. A system as in claim 1 wherein the container is heated to a temperature of at least 135° F for 12 seconds ± 2 seconds.

3. A system as in claim 1 further including a second casing having a container for receiving the semen straws after they have been heated, electrical heating means for the second container, the second container tending to hold said straws at a preset temperature, and means for selectively attaching the first casing to the second casing.

* * * * *